US012757983B2

(12) United States Patent
Zhou

(10) Patent No.: US 12,757,983 B2
(45) Date of Patent: Oct. 13, 2026

(54) CREATIVE ORNAMENT

(71) Applicant: Qiang Zhou, Yulin (CN)

(72) Inventor: Qiang Zhou, Yulin (CN)

( * ) Notice: Subject to any disclaimer, the term of this patent is extended or adjusted under 35 U.S.C. 154(b) by 0 days.

(21) Appl. No.: 19/274,691

(22) Filed: Jul. 21, 2025

(65) Prior Publication Data

US 2026/0020648 A1 Jan. 22, 2026

(51) Int. Cl.
*A44C 25/00* (2006.01)
*A44C 5/00* (2006.01)
*A44C 17/02* (2006.01)

(52) U.S. Cl.
CPC ..... *A44C 17/02* (2013.01)

(58) Field of Classification Search
CPC ... A44C 15/0015; A44C 25/00; A44C 25/001; A44C 25/007
USPC ..... 63/1.12; 362/104
See application file for complete search history.

(56) References Cited

U.S. PATENT DOCUMENTS 203,323 A * 5/1878 Closson ..... A44C 9/0053 63/15
1,333,284 A * 3/1920 Schreiber ..... A44C 9/003 224/217
4,249,330 A * 2/1981 Chioffe ..... A45C 11/24 283/76
4,416,074 A * 11/1983 Guerrero ..... G02B 27/06 63/23
5,117,338 A * 5/1992 McCrary ..... A44C 15/0015 63/26
5,323,300 A * 6/1994 McCrary ..... A44C 15/0015 63/26
6,536,235 B2 * 3/2003 Lovegrove ..... A44C 9/0069 63/29.1
2014/0160571 A1 * 6/2014 Miyazaki ..... G02B 7/02 359/614
2015/0075220 A1 3/2015 Dobashi
2016/0255979 A1 9/2016 Brinegar
2021/0137227 A1 * 5/2021 Buck ..... A44C 9/0053
2023/0102070 A1 3/2023 Lee

* cited by examiner

*Primary Examiner* — Jack W Lavinder
(74) *Attorney, Agent, or Firm* — JEEN IP LAW, LLC

(57) ABSTRACT

A creative ornament is provided, including an ornament shell. The ornament shell is formed with a projection opening and a light inlet. The projection opening and the light inlet are arranged opposite to each other, and a pattern sheet is provided between the projection opening and the light inlet. The projection opening is provided with a lens, allowing a pattern on the pattern sheet to be projected and enlarged through the lens.

13 Claims, 7 Drawing Sheets

CREATIVE ORNAMENT

TECHNICAL FIELD

The present disclosure relates to the field of ornaments, more particularly to a creative ornament.

BACKGROUND

With the improvement of people's living standards, after the satisfaction of material needs, spiritual needs also need to be met. For example, in order to highlight fashion, trends and other elements, people usually wear some ornaments for decoration. And on special holidays such as anniversaries, birthdays, Valentine's Day, etc., commemorative ornaments are often given to specific people, which is a common situation, especially for couples.

Currently, the ornaments available on the market mainly focus on creative styling, usually with static structures, which limit the display effect of the ornaments. In addition, the ornaments available on the market are mainly for the purpose of decoration, lacking strong commemorative attributes, which to some extent reduces people's desire to give each other ornaments as gifts.

SUMMARY

In order to overcome the shortcomings of the existing technologies, the present disclosure provides a creative ornament.

The present disclosure is to solve the technical problem employing the following technical scheme.

The present disclosure provides a creative ornament, including an ornament shell. The ornament shell is formed with a projection opening and a light inlet. The projection opening and the light inlet are arranged opposite to each other, and a pattern sheet is provided between the projection opening and the light inlet. The projection opening is provided with a lens, allowing a pattern on the pattern sheet to be projected and enlarged through the lens.

The lens is a convex lens.

The lens has a rear end extending toward the pattern sheet to form a light guide portion.

The light guide portion has an external surface provided with a light blocking layer.

The light guide portion is cylindrical in shape, and the light blocking layer is circumferentially distributed along the external surface of the light guide portion.

The light blocking layer is a frosted layer.

The lens is inserted into the projection opening by means of the light guide portion.

The light guide portion and the lens are integrally formed.

An end surface of the light guide portion facing the pattern sheet is a light guide end surface, and the pattern sheet is arranged on the light guide end surface.

The light guide end surface and the pattern sheet are arranged basically in parallel, and the light guide end surface and the pattern sheet are basically perpendicular to a central line of the light inlet.

The pattern sheet is non-removably fixed on the light guide end surface.

The pattern sheet is bonded onto the light guide end surface by means of a transparent adhesive, allowing the pattern sheet to be non-removably fixed on the light guide end surface.

The pattern sheet is a film.

The pattern sheet includes a light-transmitting carrier. The light-transmitting carrier is provided with at least one light-proof layer, and the light-proof layer is formed with a hollow pattern.

The light-proof layer is single colored or multicolored.

The ornament shell is provided with a decorative piece.

The ornament shell is further provided with a connection part.

The creative ornament can be a creative bracelet, a creative necklace and so on.

The present disclosure further provides a creative ornament, including an ornament shell. The ornament shell is formed with a projection opening and a light inlet. The projection opening and the light inlet are arranged opposite to each other, and a pattern sheet is provided between the projection opening and the light inlet. The projection opening is provided with a lens. The lens having a front end provided with a convex lens and a rear end provided with a light guide end surface. The pattern sheet is arranged on the light guide end surface, allowing a pattern on the pattern sheet to be projected and enlarged through the lens.

The present disclosure further provides a creative ornament, including an ornament shell. The ornament shell is formed with a projection opening and a light inlet. The projection opening and the light inlet are arranged opposite to each other, and a pattern sheet is provided between the projection opening and the light inlet, wherein a pattern on the pattern sheet can be a customized pattern. The projection opening is provided with a lens, allowing the customized pattern on the pattern sheet to be projected and enlarged through the lens.

The present disclosure has the following beneficial effects. With the above structure arrangement, the pattern on the pattern sheet can be projected and enlarged through the lens during usage. In particular, since light can enter inside of the ornament shell via the light inlet, a user can directly watch the pattern on the pattern sheet through the lens. Further, the user can also direct a light source (for example, a fill light on a phone, etc.) at the light inlet, allowing the light to pass through the pattern sheet and the lens in sequence to form a projection onto an outside object (for example, onto a wall, a ceiling, etc.)

In this way, in the creative ornament of the present disclosure, a creative design of pattern projection is further added on the basis of the original decorative function, which integrates multiple pattern display methods, endowing the ornament with multi-dimensional decorative and display effects. In addition, the pattern on the pattern sheet can be a commemorative pattern for a certain festival, can be a photo of an important person, can be a privately customized pattern, etc., which effectively enhances the commemorative attribute of the ornament and enhances people's desire to give ornaments as gifts. Such creative ornaments are very attractive, especially for couples.

BRIEF DESCRIPTION OF THE DRAWINGS

For a better understanding of the technical scheme in the embodiments of the present disclosure, accompanying drawings required to be used in the description of the embodiments are simply illustrated below. The accompanying drawings described below are some embodiments of the present disclosure merely. For the ordinary skill in the field, other accompanying drawings may be obtained without creative effort according to these accompanying drawings.

The present disclosure is described below in further detail in conjunction with the drawings and embodiments.

DETAILED DESCRIPTION OF THE EMBODIMENTS

Figure 1:
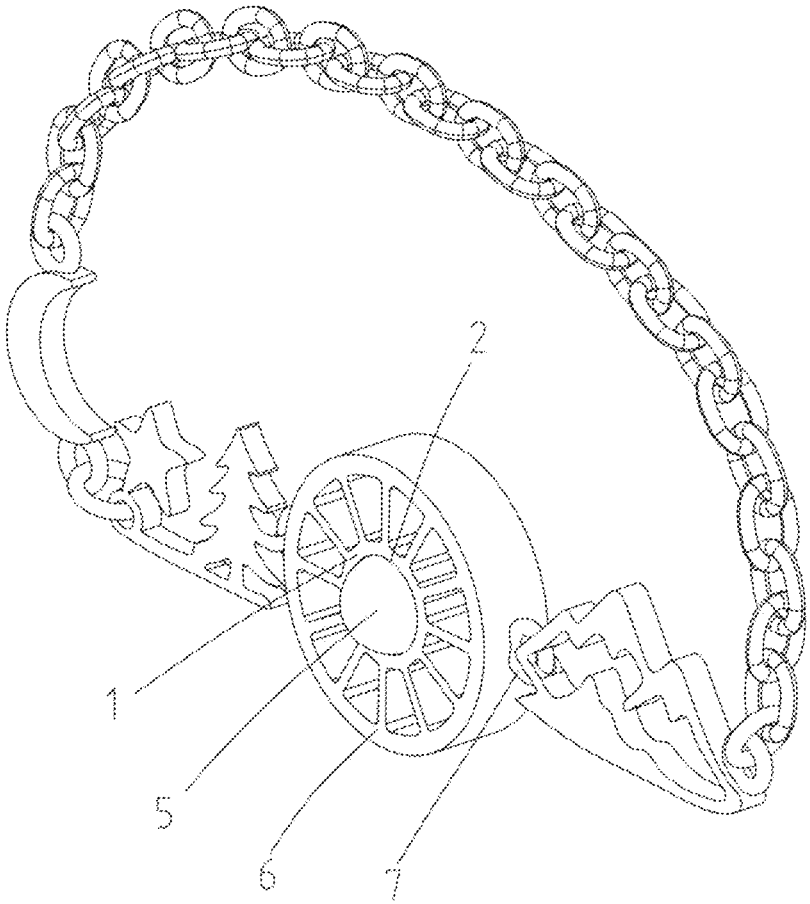
FIG. 1 is a structure diagram of a front side of a creative ornament.
Figure 2:
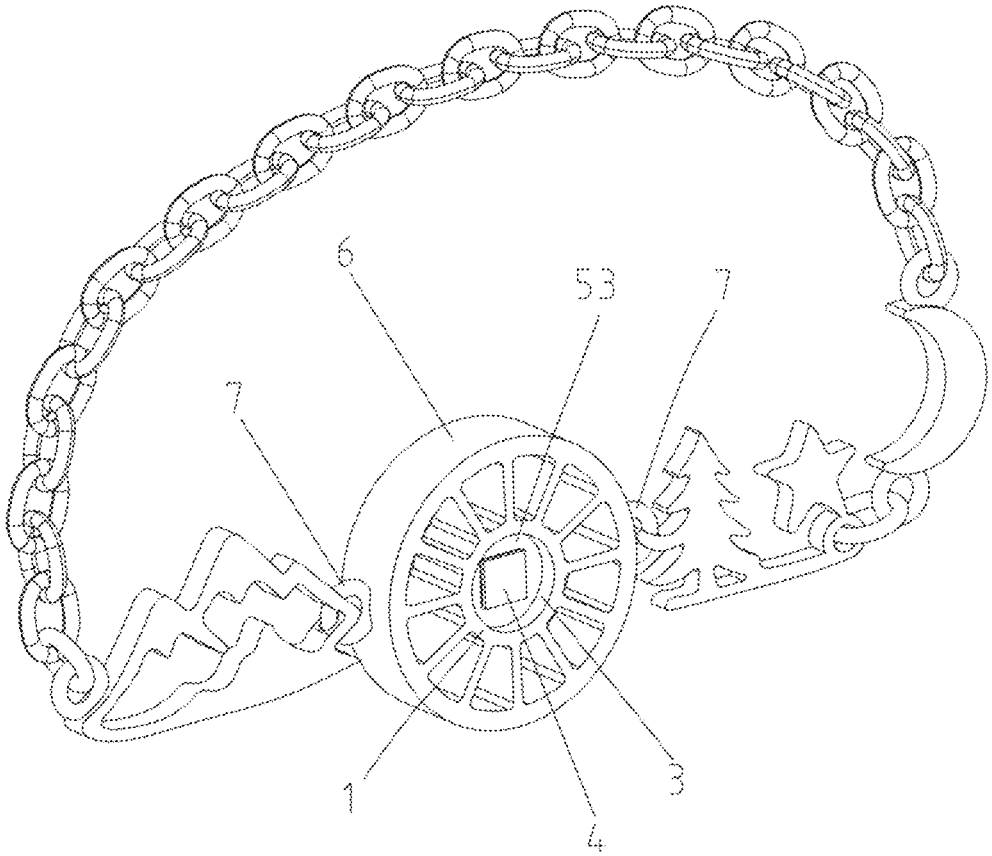
FIG. 2 is a structure diagram of a back side of a creative ornament.

Referring to FIG. 1 to FIG. 7, a creative ornament includes an ornament shell 1. The ornament shell 1 is formed with a projection opening 2 and a light inlet 3. The projection opening 2 and the light inlet 3 are arranged opposite to each other, and a pattern sheet 4 is provided between the projection opening 2 and the light inlet 3. The projection opening 2 is provided with a lens 5, allowing a pattern on the pattern sheet 4 to be projected and enlarged through the lens 5.

With the above structure arrangement, the pattern on the pattern sheet can be projected and enlarged through the lens during usage. In particular, since light can enter inside of the ornament shell via the light inlet, a user can directly watch the pattern on the pattern sheet through the lens. Further, the user can also direct a light source (for example, a fill light on a phone, etc.) at the light inlet, allowing the light to pass through the pattern sheet and the lens in sequence to form a projection onto an outside object (for example, onto a wall, a ceiling, etc.)

In this way, in the creative ornament of the present disclosure, a creative design of pattern projection is further added on the basis of the original decorative function, which integrates multiple pattern display methods, endowing the ornament with multi-dimensional decorative and display effects. In addition, the pattern on the pattern sheet can be a commemorative pattern for a certain festival, can be a photo of an important person, can be a privately customized pattern, etc., which effectively enhances the commemorative attribute of the ornament and enhances people's desire to give ornaments as gifts. Such creative ornaments are very attractive, especially for couples.

In particular, the lens 5 is a convex lens, which can well enlarge the pattern on the pattern sheet through projection, with simple and reliable structure.

Further, the lens 5 has a rear end extending toward the pattern sheet 4 to form a light guide portion 51, and the light guide portion 51 has an external surface provided with a light blocking layer 52. In this way, the light can be transmitted to the lens through the light guide portion, and the arrangement of the light blocking layer can ensure the light does not diverge outward, enhancing the effect of projection.

In particular, the light guide portion 51 is cylindrical in shape, allowing the shape of light guide portion to well adapt to the shape of the lens. Preferably, the light guide portion 51 and the lens 5 are integrally formed. Correspondingly, the light blocking layer 52 is circumferentially distributed along the external surface of the light guide portion 51, enabling a more reasonable structure design.

Figure 5:
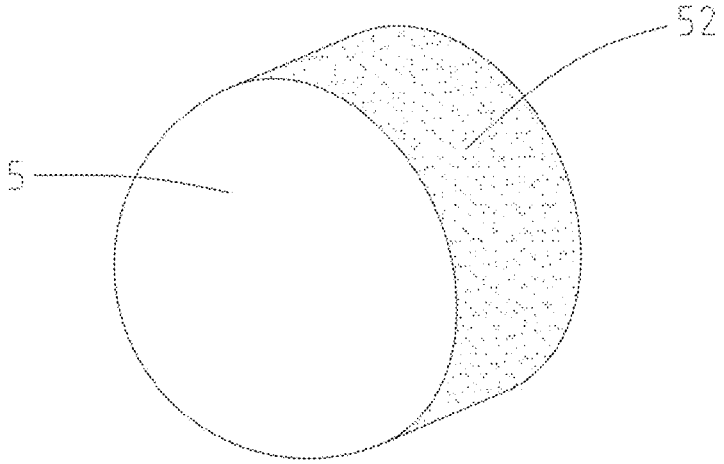
FIG. 5 is a structure diagram of a lens.

In particular, referring to FIG. 5, the light blocking layer 52 is a frosted layer, which has a simple structure and is easy to manufacture.

In particular, an end surface of the light guide portion 51 facing the pattern sheet 4 is a light guide end surface 53. The pattern sheet 4 is arranged on the light guide end surface 53, which is conducive to the projection of the pattern on the pattern sheet and the fixation of the pattern sheet. In addition, the pattern sheet 4 is non-removably fixed on the light guide end surface 53. In particular, the pattern sheet 4 is bonded onto the light guide end surface 53 by means of a transparent adhesive, allowing the pattern sheet 4 to be non-removably fixed on the light guide end surface 53. The adhesive can specifically be a UV (Ultraviolet Rays) adhesive, which has good light-transmitting properties and good adhesive properties, especially suitable for fixation of pattern sheet.

In particular, the light guide end surface 53 and the pattern sheet 4 are arranged basically in parallel, and the light guide end surface 53 and the pattern sheet 4 are basically perpendicular to a central line of the light inlet 3. In this way, the light guide end surface 53 and the pattern sheet 4 are basically perpendicular to a central line of the projection opening. With the above structure arrangement, the light inlet, the pattern sheet, the light guide portion and the lens (projection opening) can form a light path in sequence, enabling a better effect of projection and a more reasonable structure design.

In some embodiments, the lens 5 is inserted into the projection opening 2 by means of the light guide portion 51, enabling a simple structure and an easy installation. In addition, an adhesive can be provided between the light guide portion and the projection opening to achieve a firmer installation of the lens. The adhesive can be a UV (Ultraviolet Rays) adhesive.

Figure 3:
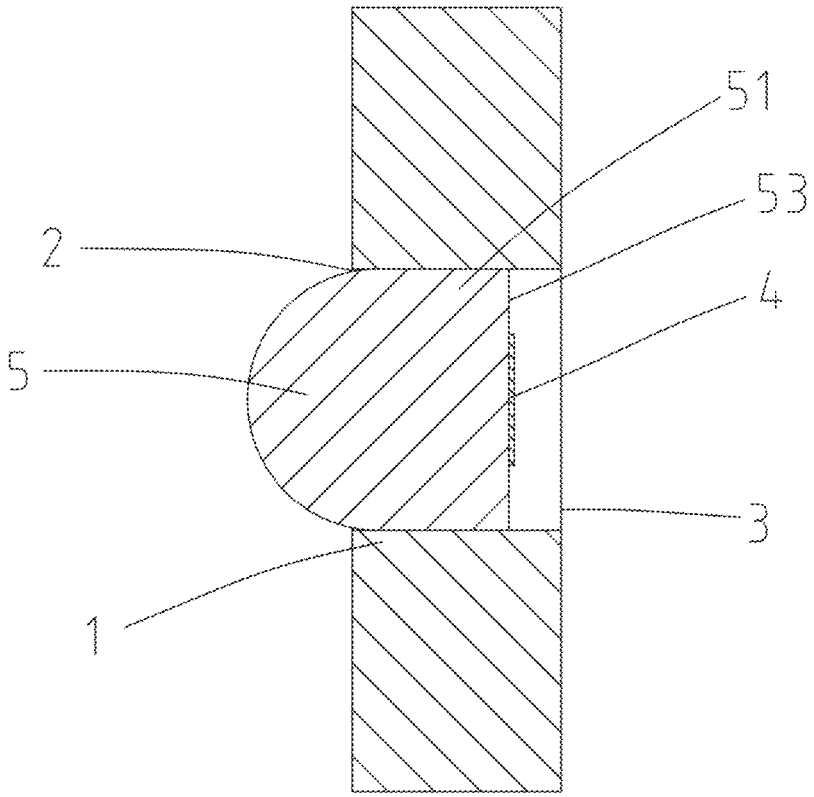
FIG. 3 is a sectional view of a creative ornament, in which a pattern sheet is a film.

In some embodiments, referring to FIG. 3, the pattern sheet 4 is a film, which facilitates the formation of pattern, has a simple structure, and is easy to manufacture. The pattern formed on the film can be a heart-shaped pattern, a couple portrait pattern, etc.

Figure 4:
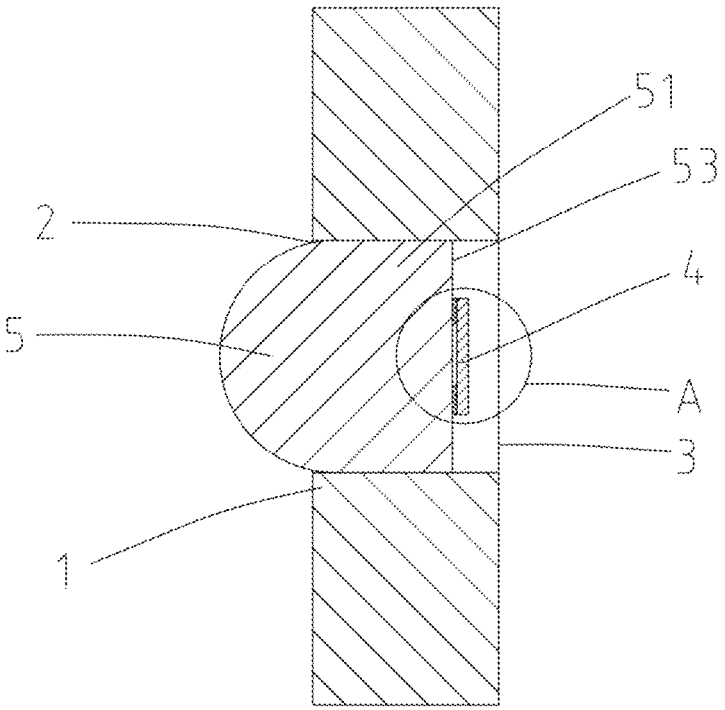
FIG. 4 is a sectional view of a creative ornament, in which a pattern sheet is composed of a light-transmitting carrier and a light-proof layer.
Figure 6:
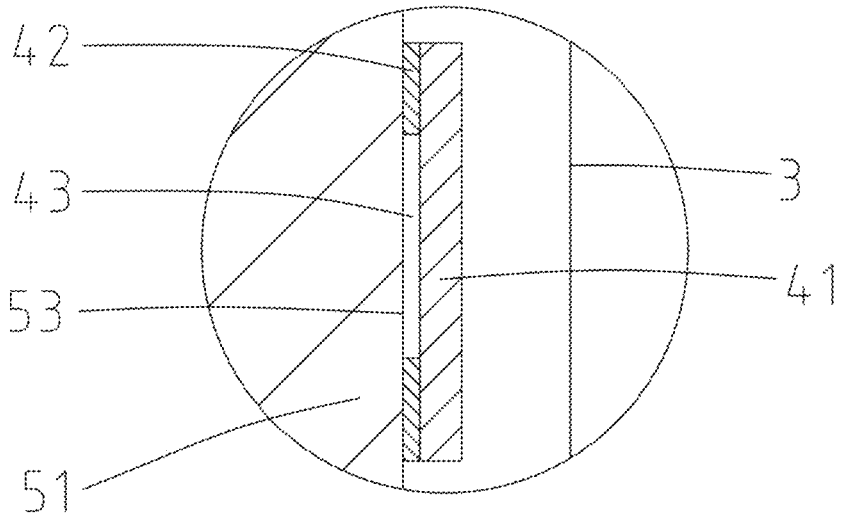
FIG. 6 is an enlarged view of part A in FIG. 4.
Figure 7:
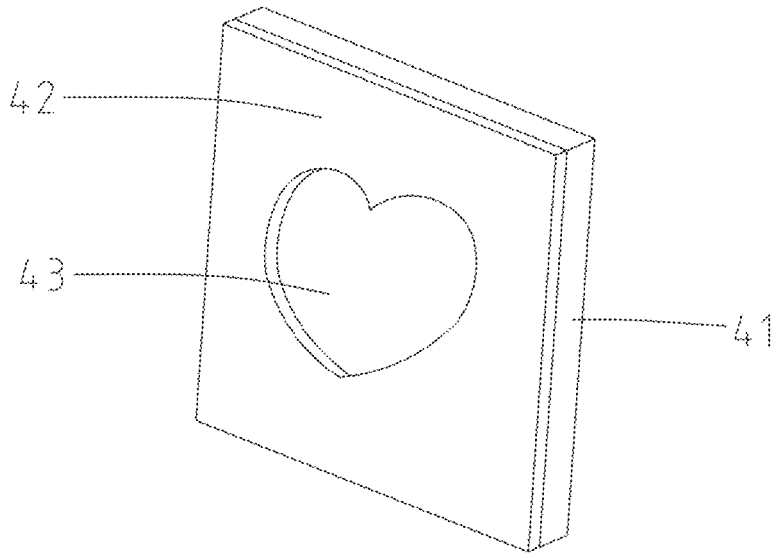
FIG. 7 is a structure diagram of a pattern sheet which is composed of a light-transmitting carrier and a light-proof layer.

In some embodiments, referring to FIG. 4, FIG. 6 and FIG. 7, the pattern sheet 4 includes a light-transmitting carrier 41. The light-transmitting carrier 41 is provided with at least one light-proof layer 42, and the light-proof layer 42 is formed with a hollow pattern 43. In particular, a hollow pattern can be formed on the light-proof layer 42 using the process of laser micro carving. Further, a more complex pattern can be obtained by arranging multiple light-proof layers. Herein, the light-proof layer can be a coating, the light-transmitting carrier can be a glass sheet, and the hollow pattern, for example, can be a heart-shaped pattern, a couple portrait pattern, etc.

Further, the light-proof layer 42 is single colored or multicolored. The multicolored arrangement can form a pattern of different colors, enabling a better effect of pattern projection.

In the creative ornament of the present disclosure, the ornament shell 1 is provided with a decorative piece 6, allowing the creative ornament to have a basic decorative effect. In addition, the ornament shell 1 is further provided with a connection part 7. The connection part can be in various forms of structures, such as connection hole, hinge hole, etc., which are not limited here. The ornament shell can be connected to a chain through the connection part, whereby the creative ornament can form a creative bracelet, a creative necklace, etc.

The above are one or more embodiments provided in conjunction with specific contents, and it should not be assumed that the specific embodiments of the present disclosure are limited to these descriptions. Any approximation or similarity to the method, structure, etc. of the present disclosure, or any technical deduction or substitution made under the premise of the concept of the present disclosure, should be considered within the scope of protection of the present disclosure.

What is claimed is:

1. A creative ornament, comprising an ornament shell (1), the ornament shell (1) being formed with a projection opening (2) and a light inlet (3), the projection opening (2) and the light inlet (3) being arranged opposite to each other, and a pattern sheet (4) being provided between the projection opening (2) and the light inlet (3); and the projection opening (2) being provided with a lens (5), allowing a pattern on the pattern sheet (4) to be projected and enlarged through the lens (5), and an external light source is directed at the light inlet, allowing the light to pass through the pattern sheet and the lens in sequence to form a projection onto an outside object, wherein the lens (5) is a convex lens, wherein the lens (5) has a rear end extending toward the pattern sheet (4) to form a light guide portion (51), wherein an end surface of the light guide portion (51) facing the pattern sheet (4) is a light guide end surface (53), and wherein the pattern sheet (4) is arranged on the light guide end surface (53), wherein the pattern sheet (4) is non-removably fixed on the light guide end surface (53), wherein the pattern sheet (4) is bonded onto the light guide end surface (53) by means of a transparent adhesive, allowing the pattern sheet (4) to be non-removably fixed on the light guide end surface (53).

2. The creative ornament according to claim 1, wherein the light guide portion (51) has an external surface provided with a light blocking layer (52).

3. The creative ornament according to claim 2, wherein the light guide portion (51) is cylindrical in shape, and the light blocking layer (52) is circumferentially distributed along the external surface of the light guide portion (51).

4. The creative ornament according to claim 3, wherein the light blocking layer (52) is a frosted layer.

5. The creative ornament according to claim 1, wherein the lens (5) is inserted into the projection opening (2) by means of the light guide portion (51).

6. The creative ornament according to claim 1, wherein the light guide portion (51) and the lens (5) are integrally formed.

7. The creative ornament according to claim 1, wherein the light guide end surface (53) and the pattern sheet (4) are arranged basically in parallel, and wherein the light guide end surface (53) and the pattern sheet (4) are basically perpendicular to a central line of the light inlet (3).

8. The creative ornament according to claim 1, wherein the pattern sheet (4) is a film.

9. The creative ornament according to claim 1, wherein the pattern sheet (4) comprises a light-transmitting carrier (41), the light-transmitting carrier (41) being provided with at least one light-proof layer (42), and the light-proof layer (42) being formed with a hollow pattern (43).

10. The creative ornament according to claim 9, wherein the light-proof layer (42) is single colored or multicolored.

11. The creative ornament according to claim 1, wherein the ornament shell (1) is provided with a decorative piece (6).

12. The creative ornament according to claim 11, wherein the ornament shell (1) is further provided with a connection part (7).

13. The creative ornament according to claim 1, wherein the creative ornament can be a creative bracelet, a creative necklace and so on.

* * * * *